33-246 SR

8/25/81 OR 4,285,137 fwd in 33/249 6/17/86

United States Patent [19]

Jennie

[11] 4,285,137

[45] Aug. 25, 1981

[54] TRAJECTORY COMPENSATING DEVICE

[76] Inventor: Fred L. Jennie, 112 Promontory Dr. West, Newport Beach, Calif. 92660

[21] Appl. No.: 112,369

[22] Filed: Jan. 15, 1980

[51] Int. Cl.[3] ..... G01C 3/20

[52] U.S. Cl. ..... 33/246; 33/298

[58] Field of Search ..... 33/245, 246, 247, 248, 33/297, 298

[56] References Cited

U.S. PATENT DOCUMENTS

| | | | |
|---|---|---|---|
| 3,190,003 | 1/1965 | O'Brien | 33/297 |
| 3,297,389 | 1/1967 | Gibson | 33/245 |
| 3,386,330 | 6/1968 | Burris et al. | 356/21 |
| 3,392,450 | 7/1968 | Herter et al. | 33/245 |
| 3,540,256 | 11/1970 | Thompson | 33/297 |
| 3,782,822 | 1/1974 | Spence | 33/246 |
| 4,033,046 | 7/1977 | Burris | 33/297 |

*Primary Examiner*—Steven L. Stephan
*Attorney, Agent, or Firm*—K. H. Boswell; Edward D. O'Brian

[57] ABSTRACT

A trajectory compensating device for use with a rifle scope used in aiming a firearm is improved by including in the reticle of the rifle scope two sighting planes and including on the elevational turret of the rifle scope a turret cap which includes an indicia carrying member. The two sighting planes in the reticle are a primary sighting plane and a secondary sighting plane. The elevational turret of the rifle scope includes an indexing mark located thereon. The elevational turret controls the elevational correcting system of the rifle scope by rotation of the turret cap. The indicia carrying member includes at least two indicia markings. One of these indicia markings is correlated to correspond to a calibration distance wherein the rifle scope is sighted in utilizing the primary sighting plane of the reticle. The second of the indicia corresponds to an indicator mark which when lined up with the indexing mark will assure the shooter of the firearm that the trajectory of the bullet launched from the firearm will not deviate from either the line of sight across either the primary or the secondary sighting planes of the reticle by a fixed predetermined deviation distance from the trajectory of the bullet.

8 Claims, 4 Drawing Figures

TRAJECTORY COMPENSATING DEVICE

BACKGROUND OF THE INVENTION

This invention is directed to a trajectory compensating device which includes a rifle scope having a reticle which has both a primary and secondary sighting plane and the elevational turret of the rifle scope having a turret cap which carries an indicia carrying member having a calibration mark and an indicator mark which allows for maintaining the trajectory of the bullet within a certain variable limit with regards to the line of sight to the rifle scope across both the primary and secondary sighting planes of the reticle.

One of the common problems associated with the use of rifle scopes is the inability of the shooter to correctly gauge the distance between his firearm and the target such that the elevational controls of the rifle scope can be correctly adjusted to reflect the distance. In order to compensate for this lack of distance judging ability separate range finders and/or rifle scopes with built-in range finders have been developed. The problem with these systems, however, is that they require extra time to use and if the shooter is attempting to hit a moving target such as a running deer most of the time the shooter simply does not even have time to adjust the elevational and windage turrets let alone use these devices prior to having to take a shot at the target before it disappears.

In U.S. Pat. No. 3,386,330 this problem with range finders is discussed. This patent attempts to overcome this problem by providing not a true range finder but an estimate or rapidly usable range finder. Further, this patent discusses how a bullet size and the load used in the cartridge holding that bullet will effect the trajectory of the bullet. That is, the trajectory of the bullet can result in a reasonable estimation of a point of impact error.

SUMMARY OF THE INVENTION

In view of the above it is an object of this invention to provide a trajectory compensating device which allows the shooter having once zeroed in his rifle scope to his firearm to set the elevational turret adjusting mechanism of the rifle scope on a predetermined mark and be assured that the trajectory of a bullet fired from the firearm will be within certain limits of error in striking a target. It is an additional object of this invention to provide a trajectory compensating device which because of its simplicity is readily adaptable to existing rifle scopes as well as being incorporated into custom designed rifle scopes.

These and other objects as will be evident from a remainder of the specification are achieved by providing a trajectory compensating device for use in combination with a rifle scope of the type having a reticle and a turret controlled elevational correction system including a turret which comprises: said reticle having a primary sighting plane and a secondary sighting plane; said turret including an indexing mark located on said turret; said turret including a turret cap operatively connected to said turret controlled elevational correction system so that said turret controlled elevational correction system is controlled by rotation of said turret cap about said turret; said turret cap including an indicia carrying means, said indicia carrying means including at least two individual indicia, said indicia carrying means located on said turret cap such that each of said individual indicia can be independently aligned with said indexing mark by rotating said turret cap; the first of said indicia on said indicia carrying means corresponding to a distance calibration mark wherein when said distance calibration mark is aligned with said indexing mark the line of sight through said rifle scope using said primary sighting plane of said reticle will be aligned with the center of impact on a target of a bullet of a fixed size expelled from a cartridge containing a fixed load down the muzzle of a firearm on which said rifle scope is mounted when said bullet is launched from said firearm concurrently with when said firearm is located at a distance from said target corresponding to the same distance being represented by said distance calibration mark; the second of said indicia corresponding to an indicator mark wherein when said indicator mark is aligned with said indexing mark and said bullet of said fixed side is expelled from said cartridge containing said fixed load down said muzzle of said firearm on which said rifle scope is mounted the trajectory of said bullet will first cross the line of sight through said rifle scope using said primary sighting plane of said reticle and next cross the line of sight through said rifle scope using the secondary sighting plane of said reticle and before said trajectory crosses said line of sight of said rifle scope using said primary sighting plane of said reticle the distance between said trajectory and said line of sight of said rifle scope using the primary sighting plane of said reticle as measured perpendicular from said line of sight of said rifle scope using said primary sighting plane of said reticle to said trajectory is not greater than a predetermined deviation distance and after said trajectory crosses said line of sight of said rifle scope using said primary sighting plane of said reticle but before said trajectory crosses said line of sight of said rifle scope using said secondary sighting plane of said reticle the distance between said trajectory and one of said lines of sight of said rifle scope using either said primary sighting plane of said reticle or said secondary sighting plane of said reticle as measured perpendicular from both said line of sight of said rifle scope using said primary sighting plane and said line of sight of said rifle scope using said secondary sighting plane of said reticle to said trajectory is not greater than said predetermined deviation distance.

The preferred turret cap of the invention will have at least a portion of its surface shaped as an upstanding cylinder which can readily receive the preferred form of the indicia carrying means which is an elongated strip having both the indicator mark thereon as well as at least one indicia corresponding to a distance mark. Additionally other distance marks can be included on the elongated strip to be used by the shooter when he is shooting at targets of known distances such as at a target range. Preferably the line of sight between the primary sighting plane of the reticle will be spaced from the line of sight of the secondary sighting plane of the reticle by three minutes of angle. This thus will result in the difference between the primary sighting plane and the secondary sighting plane giving lines of sight which are spaced apart from each other at 9 inches at 300 yards thus setting the deviation distance to be no greater than $4\frac{1}{2}$ inches.

BRIEF DESCRIPTION OF THE DRAWING

This invention will be better understood when taken in conjunction with the drawing wherein.

Figure 1:
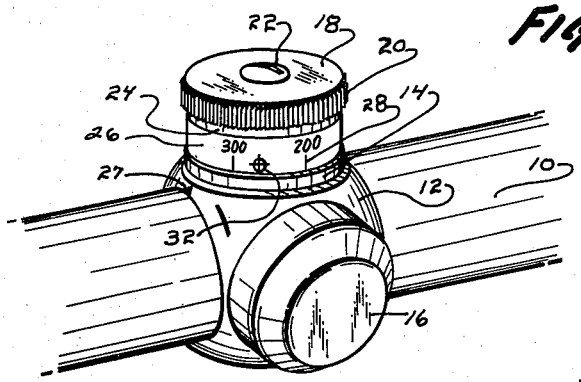
FIG. 1 is an isometric view of a turret of a rifle scope showing the preferred form of the turret cap of this invention and an example of the preferred form of an indicia carrying elongated strip attached thereto.

This invention utilizes certain principles and/or concepts as are set forth and defined in the claims appended to this specification. Those skilled in the art to which this invention pertains will realize that these principles and/or concepts could be utilized with a number of differently appearing embodiments differing from the embodiments described herein. For this reason this invention is to be construed in light of the claims and is not to be construed as being limited to the exact embodiment shown in the drawing and described in this specification.

DETAILED DESCRIPTION

Before describing how this invention operates or how the component parts of the invention interrelate to one another a simple listing of the few terms related to the invention is needed. The invention is adapted to fit onto a rifle scope which is mounted on a firearm. The firearm utilizes a cartridge which has a bullet located therein which is propelled by a load encased within the cartridge. No numbers are given for these components since they in fact do not form a part of this invention. However, in order to understand the invention it will be necessary to refer to these components.

In FIG. 1 a section of the barrel 10 of the rifle scope is shown. On this barrel 10 is a saddle 12 which carries for the purpose of describing this invention at least one turret 14. This turret 14 is the elevational turret. Normally the saddle 12 would also contain a second turret, a windage turret, which would be mounted on the other projection 16 located on the saddle 12. Since the windage turret forms no part of this invention it is not shown in FIG. 1. Located on turret 14 is a turret cap 18. This turret cap 18 contains knurled edges 20 around its upper perimeter which allow for ease of rotation of the cap 18. The cap 18 is connected to the internal mechanism of the turret 14 by a screw 22. This internal mechanism is one of any standard elevational correction mechanisms. The cap 18 has an upstanding cylindrical wall 24 around which is wrapped an elongated indicia carrying strip 26. At the base of the turret 14 is an indexing mark 27. This mark 27 is stationary with respect to rotation of the cap 18.

Figure 2:
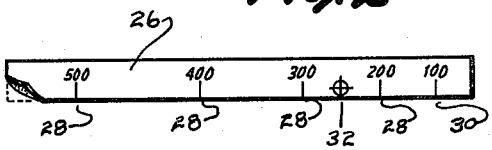
FIG. 2 is a plane view of a second example of the indicia carrying strip of FIG. 1 as it would appear if detached from the turret cap and located in a plane.

The indicia carrying strip 26 is better seen in FIG. 2 where it is stretched out in a flat plane. Located on the indicia carrying strip 26 are a plurality of distance markings collectively identified by the numeral 28 except for the 100 yard marking identified by the numeral 30. The 100 yard marking 30 for the purposes of this specification will be used as a calibration mark and will be referred to interchangeably either as the 100 yard mark or the calibration mark. It is to be understood that any of the distance marks 28 could also be used as a calibration mark but because of convention in calibrating a rifle scope and because of increased error as distance increases it is preferred to utilize the 100 yard mark as the calibration mark. In FIG. 2 located between the 200 and 300 yard distance marks 28 is an indicator mark 32.

Figure 3:
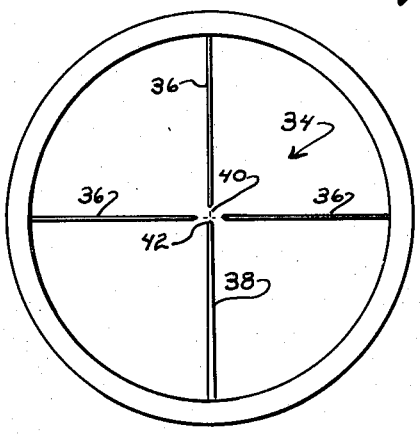
FIG. 3 is an end elevational view of the reticle of this invention is viewed through the eyepiece of a rifle scope incorporating the same.

Referring now to FIG. 3 one is viewing the reticle 34 as seen looking through the eyepiece of a rifle scope toward the objective end of a rifle scope. The reticle 34 has three supporting rods 36 and a bottom post 38. Connected to the supporting rods 36 and the bottom post 38 is a cross hair 40 which forms the primary sighting plane of the reticle 34. The top 42 of bottom post 38 forms a secondary sighting plane of the reticle 34.

Figure 4:
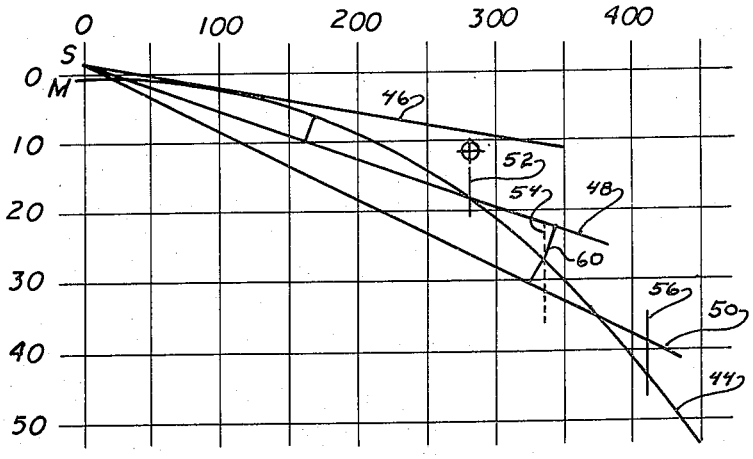
FIG. 4 is a graph illustrating the use of the invention.

FIG. 4 is a graph useful in understanding how the invention works. The horizontal axis lines refer to inches and are spaced apart from each other to represent 10 inches. Thus the graph vertically from top to bottom indicates from zero to 50 inches. The vertical axis lines of the graph represent yards and each vertical line is spaced apart from the other by a distance corresponding to 50 yards. The graph therefore covers from zero to 450 yards.

The capital M located at the zero inch and zero yard mark represents the exit end of the muzzle of a firearm. The capital S spaced above the capital M by a distance equal to approximately $1\frac{1}{2}$ graph inches represents the rifle scope.

Normally the rifle scope will be mounted above the muzzle of a firearm by a distance of approximately $1\frac{1}{2}$ inches and therefore this distance was chosen for the purpose of the graph of FIG. 4. The trajectory of a representative bullet exiting the muzzle M of a firearm is shown as line 44. Three other slope lines—zeroing slope line 46, primary sighting line 48 and secondary sighting line 50—are shown originating from the capital S. A vertical line 52 represents a line corresponding to the indicator mark 32. A dotted vertical line 54 is a cross-over line and an additional vertical line 56 indicates an approximate end of range line. A line labled 58 which is perpendicular to line 48 touches the trajectory line 44. This line will be identified as the deviation line 58. A line 60 crossing cross-over line 54 and trajectory line 44 is approximately perpendicular both to the primary line 48 and secondary line 50. This line 60 will be identified as the double deviation line. The line 60 is shown as approximately double in length as line 58; however, as hereinafter described can vary with respect to line 58.

For every given bullet size loaded in a cartridge having a particular sized load a trajectory is obtainable. Normally the manufacturer of the cartridges determine and provide the trajectory of the bullet of these cartridges. It is, however, possible for a marksman or hunter to calculate these trajectories by actually test firing the bullets using an appropriately fixedly held firearm and an accurately set up target range.

In using the trajectory compensating device of the invention an elongated strip 26 having a particular set of indicia located thereon as herein explained is mounted on the turret cap 18 as shown in FIG. 1. The firearm is then zeroed by sighting in the firearm to a center of impact of a group of bullets on a target at a known distance preferably 100 yards. For the remainder of this specification the 100 yard mark will be used as the distance in which the rifle is zeroed.

After zeroing, the screw 22 holding the cap 18 to the elevational correcting system of the rifle scope is loosened. The cap 18 is turned until the calibration mark 30 corresponding to the 100 yard mark is directly opposite the indexing mark 27 on the turret 14. Care is taken in doing this to ensure that the screw 22 is loose enough that when the cap 18 is turned the elevational correction system is not disturbed. When the calibration mark 30 is opposite the indexing mark 27 the screw 22 is tightened reconnecting control of the elevational correction system with the turret cap 18.

The trajectory 44 of the particular bullet and cartridge load can then be plotted as a line on a graph as shown in FIG. 4. From the trajectory as given by the manufacturer or as actually determined in test firing the known drop of the bullet at 100 yards is marked on the graph and the trajectory is connected through the muzzle point M to the 100 yard mark and beyond. The zeroing slope line 46 can be plotted if desired. An arbitrary deviation value is then chosen. This value is one which will equal an acceptable "hold-over or hold-under" value for the particular type of shooting which will be done. If big game is being hunted normally if the bullet strikes the target within 4 to 5 inches of its intended point of impact a kill will result. A hold-over or hold-under of 4 or 5 inches is therefore acceptable. Thus, for this type of shooting the deviation distance would be set at 4 to 5 inches. If target shooting is being done the shooter might require a closer deviation value and may set his limits even closer, i.e., 1 or 2 inches. In any event, a deviation value is chosen.

Using pre-existing tables such as those found in Ingalls' Ballistics Tables, computer calculations using known mathematical formulas or preparing graphs similar to the one shown in FIG. 4 it is possible to obtain a line 48 which will be no further from a trajectory line 44 than a predetermined deviation distance as represented by line 58. Given the trajectory of any bullet of a given weight or size loaded in any cartridge of a known load size a graph can be prepared which will yield a cross-over point between a primary sighting line 48 and the trajectory 44 of the individual bullet and load. Having obtained the cross-over point it is then possible to read off a graph a vertical line 52 and incorporate this vertical line 52 as an indicator mark 32 on an indicia carrying strip 26. Thus, a plurality of indicia carrying strips 26 can be prepared which correspond to a plurality of bullets and load sizes such as, for example, a 30-06 cartridge having a 110 grain load and a PSP bullet. Such a bullet when its trajectory is graphed would yield a vertical line 52 at 315 yards and thus on an elongated strip 26 the indicator mark 32 would be located close to the 300 yard mark between it and the 400 yard mark. A 30-06 cartridge using a 180 grain load and a PSPCL or ST bullet would yield an elongated strip 26 wherein the indicator mark 32 is at approximately the 280 yard mark as shown in FIG. 1. Likewise a 30-06 cartridge with a 220 grain load with a SPCL or PP(SP) bullet would yield an elongated strip 26 such as that shown in FIG. 2 wherein the indicator mark 32 is at approximately 255 yards.

Having determined an acceptable deviation difference the deviation difference can be plotted on the other side of the line 52 as one-half of line 60. This line is extended to its full length giving line 60 which is equal in value to double line 58. A secondary line 50 can then be drawn from point S to the bottom of line 60. On the other side of where line 50 crosses trajectory 44 an end of range line 56 can be drawn. The distance between the cross hair 40 and the top 42 of bottom post 38 can be correlated to equal the angle between lines 48 and 50 as determined by a graph such as FIG. 4. Conversely it can be decided a priori that the angle between lines 48 and 50 will be a set angle such as three minutes of angle. Thus, the length of double deviation lines 60 may or may not correlate with double the length of deviation line 58.

One might choose to set the angle between lines 48 and 50 to equal a value such as three minutes of angle because at 300 yards three minutes of angle will yield a deviation of approximately 9 inches. A normal deer'-body from his shoulder to his brisket is approximately 18 inches. A shooter in looking through his rifle scope could then very easily estimate half of this distance to be approximately 9 inches.

The line 48 correlates with the line of sight through the rifle scope utilizing the primary sighting plane or cross hairs 40 of the reticle 34. The line 50 correlates with the line of sight through the rifle scope utilizing the secondary sighting plane across the top 42 of bottom post 38. Utilizing the example shown in FIG. 4 if the indicator mark 32 was aligned with the indexing mark 27 the shooter would be assured that he would be within the deviation distance equal to the line 58, i.e., about $4\frac{1}{2}$ inches for this figure whenever his target was within from zero yards to 280 yards. Further, beyond 280 yards up to approximately 335 yards he would know that his target was still within the deviation distance. Thus, a safe shot could be taken up to at least 280 yards and to somewhere beyond approaching 330 yards.

If the reticle 34 utilized in the rifle scope was set such that the cross hairs 40 deviated from top 42 of bottom post 38 by three minutes of angle the shooter would know that at 300 yards this distance would represent approximately 9 inches. If in viewing a target such as a deer the distance between the shoulder and the brisket of the deer was greater than half of the distance between the cross hairs 40 and the top 42 of the bottom post 38 the shooter would know that he was within 300 yards of the deer and would know that he was safe in using the primary sighting plane of the reticle 34 when the indicator mark 32 was aligned with the indexing mark 27. If in viewing the same deer as a target and half the distance between the shoulder and the brisket was less than the distance between the cross hairs 40 and the top 42 of bottom post 38 the shooter would know that he was at or beyond the cross-over point 54. At this point the shooter would then sight along the secondary plane of the reticle 34 the top 42 of bottom post 38 and he would be assured that he was within the deviation distance up to a point somewhere beyond 400 yards.

It can be seen that if the indicator mark 32 is aligned with the indexing mark 27 the shooter must make only one mental judgment before deciding whether to use the primary sighting plane or the secondary sighting plane. This mental judgment would simply be an estimation of the amount of inches of the target located between the cross hairs 40 and the top 42 of bottom post 38.

In variable power scopes of the type wherein the target'magnification is variable but the reticle'is not, one standard power must be chosen to use whenever a comparison using the cross hairs 40 and the top 42 of bottom post 38 is made. The actual distance between the cross hairs 40 and the top 42 of bottom post 38 is, of course, covered by the power chosen as the standard.

I claim:

1. A trajectory compensating device for use in combination with a rifle scope of the type having a reticle and a turret controlled elevational correction system including a turret which comprises:

said reticle having a primary sighting plane and a secondary sighting plane;

said turret including an indexing mark located on said turret;

said turret including a turret cap operatively connected to said turret controlled elevational correction system so that said turret controlled elevational correction system is controlled by rotation of said turret cap about said turret;

said turret cap including an indicia carrying means, said indicia carrying means including at least two individual indicia;

said indicia carrying means located on said turret cap such that each of said individual indicia can be independently aligned with said indexing mark by rotating said turret cap;

the first of said indicia on said indicia carrying means corresponding to a distance calibration mark wherein when said distance calibration mark is aligned with said indexing mark the line of sight through said rifle scope using said primary sighting plane of said reticle will be aligned with the center of impact on a target of a bullet of a fixed size expelled from a cartridge containing a fixed load down the muzzle of a firearm on which said rifle scope is mounted when said firearm is located at a distance from said target corresponding to the same distance being represented by said distance calibration mark;

the second of said indicia corresponding to an indicator mark wherein when said indicator mark is aligned with said indexing mark and said bullet of said fixed size is expelled from said cartridge containing said fixed load down said muzzle of said firearm on which said rifle scope is mounted the trajectory of said bullet will first cross the line of sight through said rifle scope using said primary sighting plane of said reticle and next cross the line of sight through said rifle scope using the secondary sighting plane of said reticle and before said trajectory crosses said line of sight of said rifle scope using said primary sighting plane of said reticle the distance between said trajectory and said line of sight of said rifle scope using the primary sighting plane of said reticle as measured perpendicular from said line of sight of said rifle scope using said primary sighting plane of said reticle to said trajectory is not greater than a predetermined deviation distance and after said trajectory crosses said line of sight of said rifle scope using said primary sighting plane of said reticle but before said trajectory crosses said line of sight of said rifle scope using said secondary sighting plane of said reticle the distance between said trajectory and one of said lines of sight of said rifle scope using either said primary sighting plane of said reticle or said secondary sighting plane of said reticle as measured perpendicular from both said line of sight of said rifle scope using said primary sighting plane and said line of sight of said rifle scope using said secondary sighting plane of said reticle to said trajectory is not greater than said predetermined deviation distance.

2. The trajectory compensating device of claim 1 wherein:

said line of sight through said rifle scope using said primary sighting plane of said reticle is spaced from said line of sight through said rifle scope using said secondary plane of said reticle by an angle no greater than three minutes of angle.

3. The trajectory compensating device of claim 2 wherein:

said angle is three minutes of angle.

4. The trajectory compensating device of claim 1 wherein:

said predetermined deviation distance is no greater than four and one-half inches.

5. The trajectory compensating device of claim 1 wherein:

said indicia carrying means comprises an indicia carrying member having at least two indicia marked on its surface.

6. The trajectory compensating device of claim 5 wherein:

said indicia carrying member is an elongated strip mounted on said turret cap.

7. The trajectory compensating device of claim 2 wherein:

said indicia carrying means comprises an indicia carrying member having at least two indicia marked on its surface;

said indicia carrying member is an elongated strip mounted on said turret cap.

8. The trajectory compensating device of claim 1 wherein:

when a target of a known size, which size is approximately equal to double the size of said predetermined deviation distance, is viewed through said rifle scope and the size of the image of said target viewable through said rifle scope is at least the distance between said primary sighting plane of said reticle and said secondary sighting plane of said reticle, then the desired center of impact of a bullet on said target is aligned through said primary sighting plane of said reticle, and when the size of the image of said target viewable through said rifle scope is less than the distance between said primary sighting plane of said reticle and said secondary sighting plane of said reticle, then the desired center of impact of a bullet on said target is aligned through said secondary plane of said reticle.

* * * * *